US006516822B2

(12) United States Patent
Schlier

(10) Patent No.: US 6,516,822 B2
(45) Date of Patent: Feb. 11, 2003

(54) PORTABLE CANOPY FOR USE WITH MOTOR VEHICLES

(76) Inventor: John E. Schlier, 9753 Old St. Augustine Rd., Jax, FL (US) 32257

( * ) Notice: Subject to any disclaimer, the term of this patent is extended or adjusted under 35 U.S.C. 154(b) by 191 days.

(21) Appl. No.: 09/759,689

(22) Filed: Jan. 16, 2001

(65) Prior Publication Data

US 2002/0100498 A1 Aug. 1, 2002

(51) Int. Cl.[7] ..... E04H 15/06
(52) U.S. Cl. ..... 135/88.06
(58) Field of Search ..... 135/88.06

(56) References Cited

U.S. PATENT DOCUMENTS 2,989,967 A * 6/1961 Lee
3,940,099 A * 2/1976 McClesky
5,241,977 A * 9/1993 Flores et al.

* cited by examiner

*Primary Examiner*—Robert Canfield
(74) *Attorney, Agent, or Firm*—Arthur G. Yeager

(57) ABSTRACT

A canopy support assembly comprises two major sections: a drive-on anchoring assembly and a canopy support assembly. The anchoring assembly provides a device wherein a vehicle tire can be driven thereon thereby preventing movement of the assembly. Pivotally attached to the anchoring assembly is the canopy support for at least three telescoping poles. The support assembly can be pivoted onto the anchoring assembly for storage purposes. The pole support member of the support assembly can be pivoted to vary the vertical angle of the upstanding supports for the poles to accommodate different canopy sizes and shapes depending upon the specific application. In use, pairs of the assemblies will be used, one under each front or rear tire to provide a canopy for recreational use or a cover when, for example, one is working on a vehicle engine.

25 Claims, 4 Drawing Sheets

PORTABLE CANOPY FOR USE WITH MOTOR VEHICLES

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention is directed to a portable canopy to be secured in place by the tires on a motor vehicle and particularly to canopies that are adaptable to any configuration of tires.

2. Related Art

There are a wide variety of canopy or tent structures adapted for use with motor vehicles. Many of the devices are very complex and expensive and employ cables and other apparatus that do not provide for adequate strength or stability.

BRIEF SUMMARY OF THE INVENTION

In one aspect of the invention there is provided a portable canopy for use with motor vehicles comprising an anchor assembly adapted to fit under a tire on a vehicle, a support assembly, a portable cover mountable to the support assembly, means for connecting the support assembly to the anchor assembly. The support assembly includes an elongate pole holding member having opposite end portions and a lengthwise axis. The cover includes at least one tarp and at least one canopy pole removably attachable to the pole holding member, and further including means for rotatably mounting the holding member at one end portion for selectively turning the holding member about the axis. The means for connecting includes pivot means to provide for the support assembly to be folded onto the anchoring assembly in a stored position and to provide for the support assembly to be unfolded onto a surface for supporting at least one canopy pole. The anchor assembly includes extension means for selectively increasing or decreasing the length of the anchor assembly for selectively controlling the distance between the support assembly and a vehicle when a vehicle tire is positioned on the anchoring assembly. The anchoring means is elongated and has opposite end portions, one being adapted to have a vehicle tire placed thereon for holding the canopy fixedly in place and another end portion, including pivot means for pivotally mounting the support assembly thereto. Telescoping extension means is included and further includes selectively operable positive locking means for securing the anchor assembly into one of a plurality of positions.

In another aspect of the present invention there is provided a portable canopy for use with motor vehicles comprising an anchor assembly adapted to fit under a tire on a vehicle, a support assembly, a cover mounted to the support assembly, means for connecting the support assembly to the anchor assembly, including an elongate pole holding member having opposite end portions and a lengthwise axis and a plurality of canopy poles. The support means further includes means for rotatably mounting the holding member at one end portion for selectively turning the holding member about the axis. There is also pivot means to provide for the support assembly to be folded onto the anchoring assembly in a stored position and to be unfolded onto a surface for supporting each canopy pole. The anchor assembly includes extension means for selectively increasing or decreasing the length of the anchor assembly for selectively controlling the distance between the support assembly and a vehicle when a vehicle tire is positioned on the anchoring assembly. The anchoring means is elongated and has opposite end portions, one being adapted to have a vehicle tire placed thereon for holding the cover fixedly in place onto a surface and another end portion, including pivot means for pivotally mounting the support assembly thereto. Also included is a selectively operable positive locking means for securing the anchor assembly into one of a plurality of positions. There is also a positive locking means for securing the holding member in a plurality of fixed positions.

In another embodiment of the invention there is provided a portable canopy for use with motor vehicles comprising an anchor assembly adapted to fit under a tire on a vehicle, a support assembly for supporting portable cover means mountable thereon, pivot means to provide for the support assembly to be folded onto the anchoring assembly in a stored position and to provide for the support assembly to be unfolded onto a surface for supporting at least one canopy pole. The support assembly includes an elongate pole holding member having opposite end portions and a lengthwise axis and a plurality of canopy poles, the cover means including at least one tarp adaptable to mounting on the canopy poles, the support means further including means for rotatably mounting the holding member at one end portion for selectively turning the holding member about the axis. The anchor assembly includes extension means for selectively increasing of decreasing the length of the support assembly for selectively controlling the distance between the support assembly and a vehicle when a vehicle tire is positioned on the anchoring assembly. The anchoring means is elongated and has opposite end portions, one end portion being adapted to have a vehicle tire placed thereon for holding the canopy fixedly in place and another end portion including pivot means for pivotally mounting the support assembly thereto. The anchor assembly further includes telescoping extension means for selectively lengthening the anchor assembly for controlling the distance the support means is away from a vehicle tire resting on one end portion. The telescoping extension means further includes selectively operable positive locking means for securing the anchor assembly into one of a plurality of positions. The means for rotatable mounting includes positive locking means for securing the holding member in a plurality of fixed positions.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description, taken in connection with the accompanying drawings, in which:

DETAILED DESCRIPTION OF THE INVENTION

Figure 1:
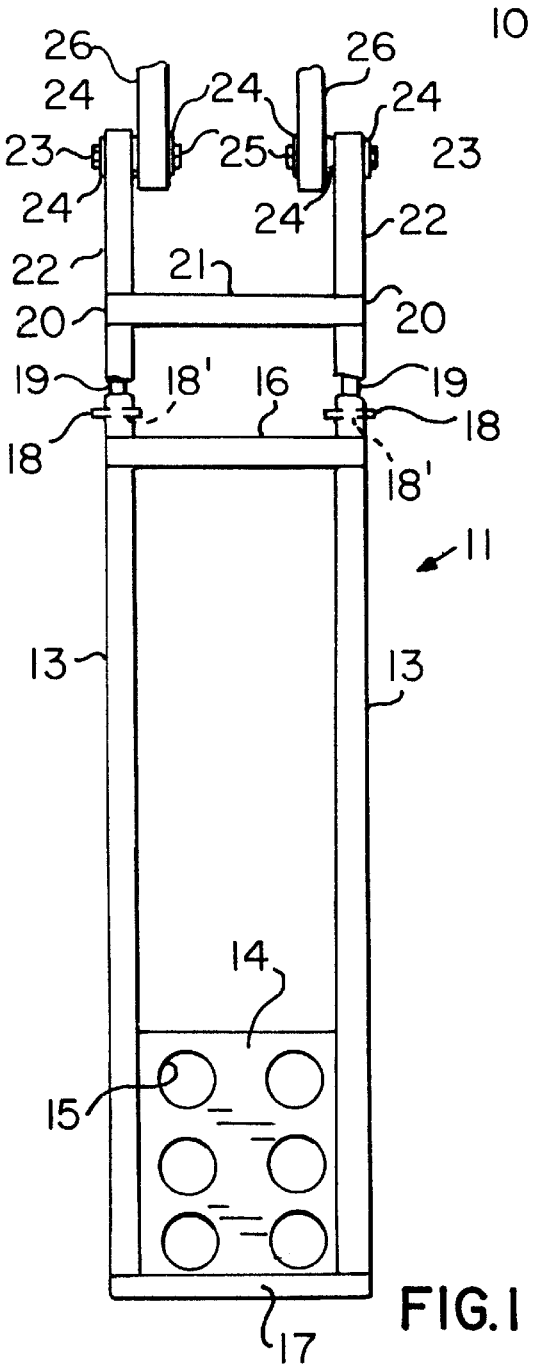
FIG. 1 is a plan view of the anchoring apparatus of the vehicle canopy in accord with the present invention.
Figure 2:
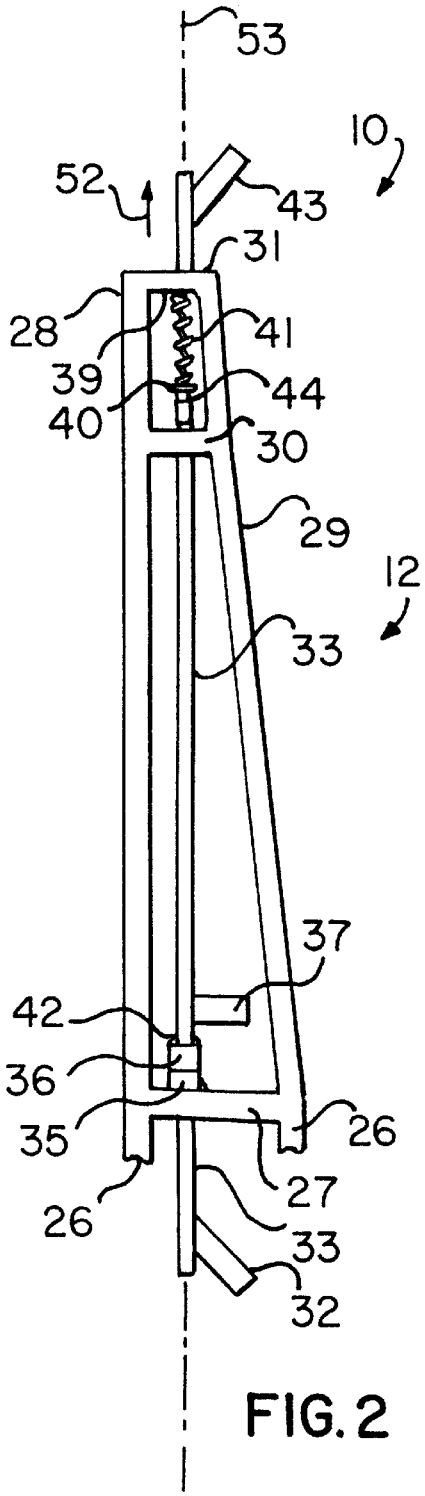
FIG. 2 is a plan view of the canopy support apparatus of the vehicle canopy in accord with the present invention.

With respect now to the drawings, the portable canopy is shown in two parts in FIGS. 1 and 2 and numeral 10. The canopy assembly 10 comprises two major sections: a drive-on anchoring assembly 11 and a canopy support assembly 12. Anchoring assembly 11 provides a device wherein a vehicle tire can be driven thereon thereby preventing movement of the assembly 11. Pivotally attached to anchoring assembly 11 is the canopy support for at least three telescoping poles. The assembly 12 can be pivoted onto assembly 11 for storage purposes. Moreover, a member of the support assembly 12 can be pivoted to vary the vertical angle of the upstanding supports for the poles to accommodate different canopy sizes and shapes depending upon the specific application.

In use pairs of the assembly 10 will be used, one under each front or rear tire to provide a canopy for recreational use or a cover when, for example, one is working on a vehicle engine.

In FIG. 1, a top view of the drive-on anchoring assembly 11 is shown ready for use; two elongate hollow metal members are welded to hollow metal members 16 and 17. Plate 14 is welded along its edges to members 13 and 17 with cutout holes 15 therein. In use, a vehicle tire 49 rests on plate 14.

Assembly 11 also includes elongate members 22 which are connected via crossbar 21. Pins 20 permanently attach the telescoping members 19 to a member 22. The other ends of members 19 fit inside members 13 and are secured into place with pins 18 that fit through holes 18' in members 13. A plurality of drilled holes 19' (FIG. 3) allow for selective length adjustment of the assembly 11.

At the end of members 22 there are bolts 23, washers 24 and nuts 25 to pivotally mount canopy support assembly 12 to the anchoring assembly 11 to permit for compact folding of the assembly 10. Support assembly 12 includes a pair of spaced elongate metal members 26 sized to fit within the space between members 22 as clearly shown in FIG. 1. Hollow cross member 27 connects members 26 to which are welded integral straight member 28 and the slanted member 29 with a forward hollow cross member 30 providing a frame for canopy pole holding rod 33.

Holding member 33 is pivotally mounted to described frame via washers 39 and 40. Member 33 includes angled rear pole socket 32, which is welded thereto. Rod 33 extends through cross members 27, 30, and 31. Middle pole holder socket 37 is preferably at a right angle to rod 33. Spring 41 is mounted between washers 39 and 40 and stop 44 biases member 31 so that the rear end of rod 33 to which is secured via weld 42 a 6-point nut 36 is held into a 12-point socket 35 secured to bar 27 via weld 34. Member 33 is rotatable about lengthwise axis 53 by pulling on angled socket 43 in the direction indicated by arrow 52 against spring 41. By releasing the support member 31, spring bias will secure it into one of a plurality of positions as desired in the circumstances.

Preferably the elongate members of the anchoring and support assemblies 11 and 12 are rectangular hollow members that provide high strength and light weight. The use of two spaced members at 13 and 22 and at 28 and 29 provides for greater lateral stability of the support 10 on ground surface 45 than would be obtained by a single member that could twist and rotate in response to the wind and perhaps collapse.

Figure 3:
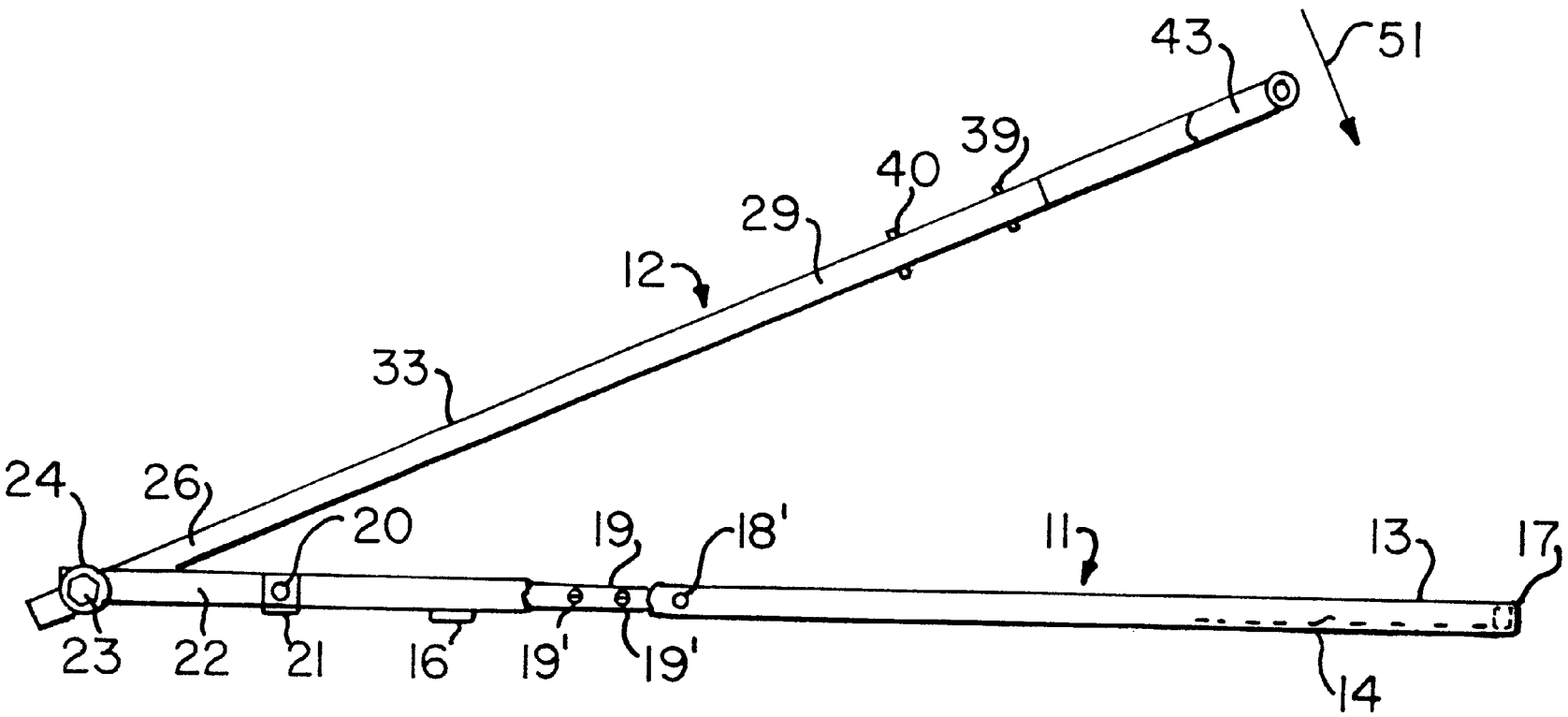
FIG. 3 is a side elevational view of the apparatus of FIG. 1 and 2 rotated by 180°.

FIG. 3 illustrates anchor assembly 11 turned upside down to provide an interior space above plate 14 for the front end of support assembly 12 to be folded down in a storage position as indicated by arrow 51.

Figure 4:
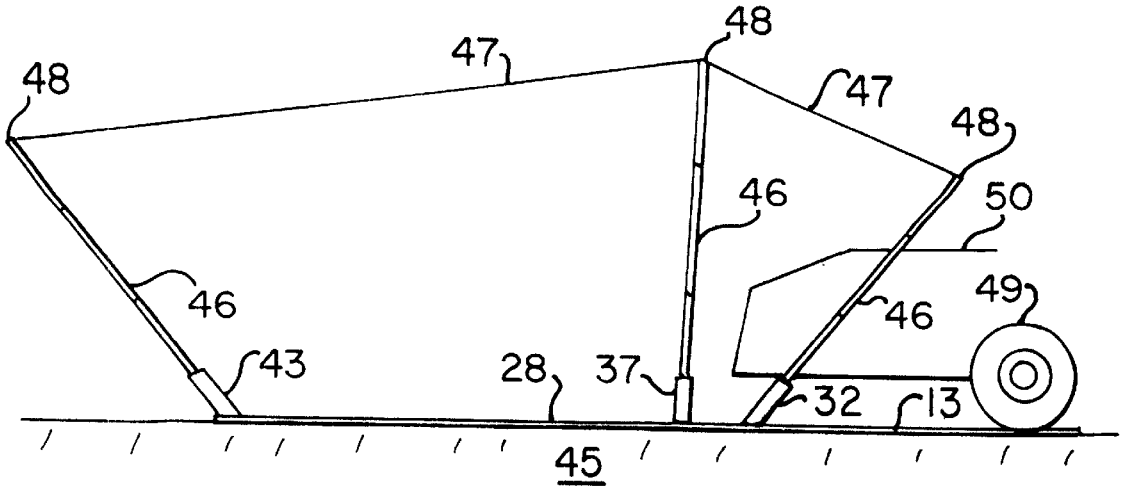
FIG. 4 is a side pictorial view of one application of the vehicle canopy in accord with the present invention.
Figure 5:
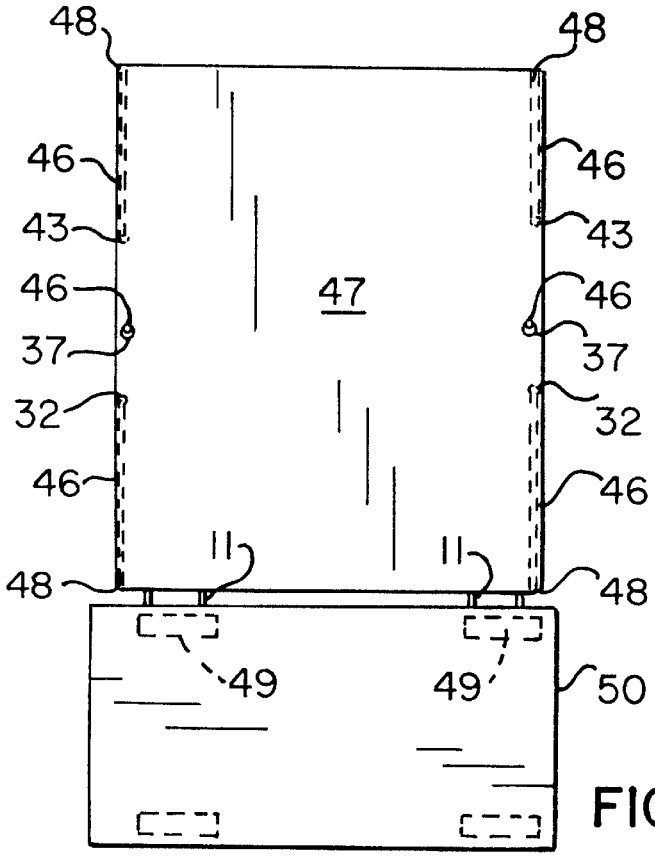
FIG. 5 is a top pictorial view of another application of the vehicle canopy in accord with the present invention.

FIGS. 4 and 5 illustrate the assembly 10 in use. Telescoping canopy holding poles 46 are inserted into the receptor sockets 32, 37 and 43 and support a tarp 47 mounted thereon by grommets 48 or any other means as understood in the art. The devices 10 are used in pairs under the front, rear, or side vehicle tires 49 as desired in the circumstances. A vehicle tire 49 can thus be driven onto plate 14 in line with assemblies 11 and 12 or crosswise as shown in FIG. 5.

Figure 6:
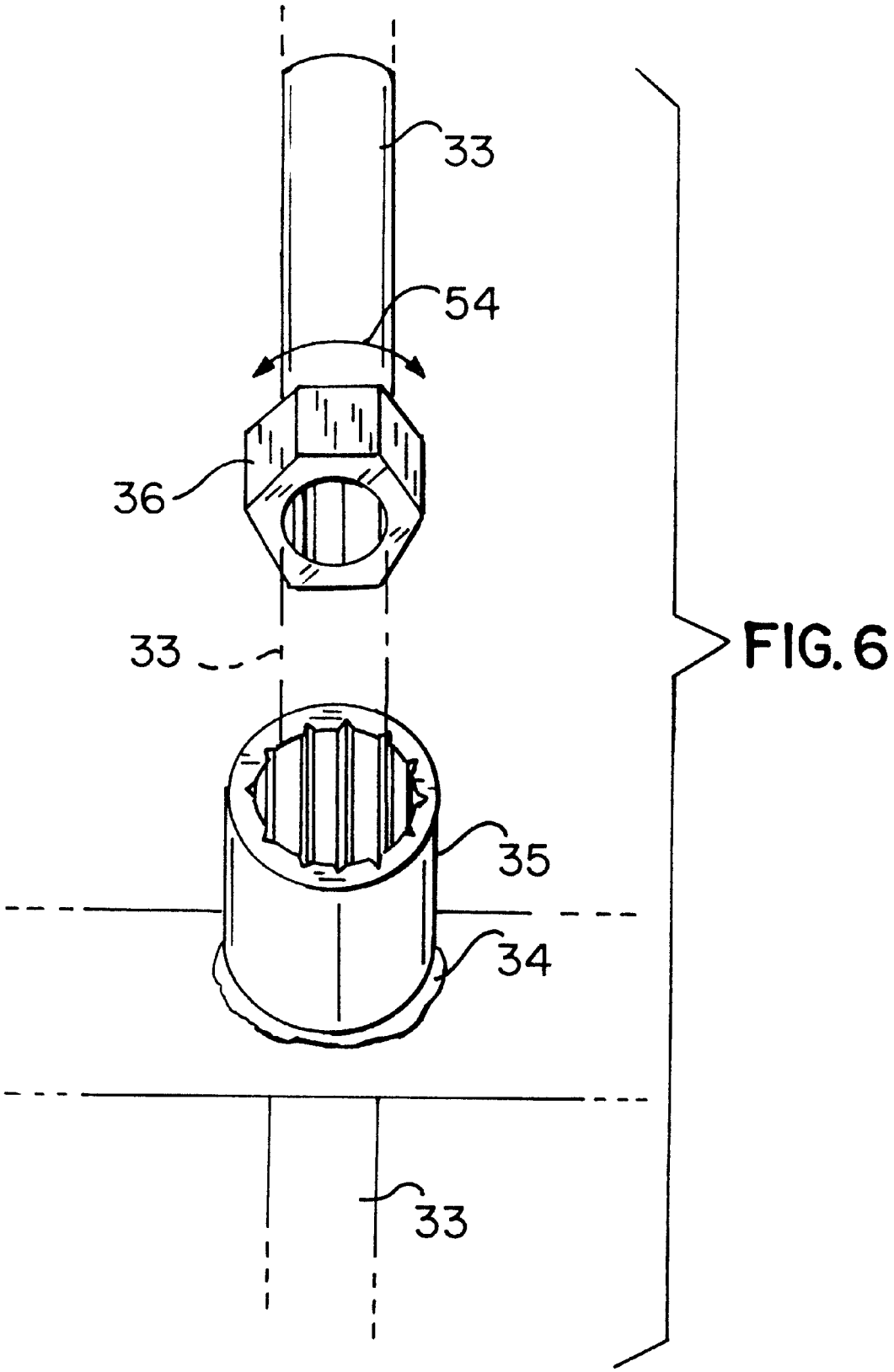
FIG. 6 is an enlarged pictorial view of socket and nut positioning apparatus used in the present invention.

FIG. 6 is a detail of the socket 35 and nut 36. The 12-point structure of socket 35 interior and the exterior of nut 36 provide for a plurality of positions and with the bias of spring 41 provide positive locking means to hold the rod 33 rigidly in position. Rod 33 passes through socket 35 and nut 36, which provides both alignment between socket 35, and nut 36 and a travel limit in the form of handle 32 and the length of spring 41.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. In a portable canopy for use with motor vehicles comprising an anchor assembly adapted to fit under a tire on a vehicle, a support assembly, a portable cover mountable to said support assembly, means for connecting said support assembly to said anchor assembly, said support assembly including an elongate pole holding member having opposite end portions and a lengthwise axis, said cover including at least one tarp and at least one canopy pole removably attachable to said pole holding member, said support assembly further including means for movably mounting said holding member at one said end portion for selectively turning said holding member about said axis.

2. In the canopy as defined in claim 1 wherein said means for connecting includes pivot means for folding said support assembly onto said anchoring assembly in a stored position and for unfolding said support assembly to be unfolded onto a surface for supporting said at least one canopy pole.

3. In the canopy as defined in claim 2 wherein said anchor assembly includes extension means for selectively increasing or decreasing the length of said anchor assembly for selectively controlling the distance between said support assembly and a vehicle when a vehicle tire is positioned on said anchor assembly.

4. In the canopy as defined in claim 1 wherein said anchor assembly is elongated and has opposite end portions, one said end portion being adapted to have a vehicle tire placed thereon for holding said canopy fixedly in place and another end portion, said another end portion including pivot means for pivotally mounting said support assembly thereto, said anchor assembly further including telescoping extension means for selectively lengthening said anchor assembly for controlling the distance said support assembly is away from a vehicle tire resting on said one end portion.

5. In the canopy as defined in claim 4 wherein said telescoping extension means further includes selectively operable positive locking means for securing said anchor assembly into one of a plurality of positions.

6. In the canopy as defined in claim 1 wherein said means for movably mounting includes positive locking means for securing said holding member in a plurality of fixed positions.

7. A portable canopy for use with motor vehicles comprising an anchor assembly adapted to fit under a tire on a vehicle, a support assembly, a cover adapted to be supported by said support assembly, means for connecting said support assembly to said anchor assembly, said support assembly including an elongate pole holding member having opposite end portions and a lengthwise axis, and a plurality of canopy poles spacedly mountable to said holding member and adapted to position a cover engageable thereon, said support assembly further including means for movably mounting said holding member at one said end portion for selectively turning said holding member about said axis.

8. The canopy as defined in claim 7 wherein said means for connecting includes pivot means for folding said support assembly onto said anchoring assembly in a stored position and unfolding said support assembly onto a surface for supporting each said canopy pole, said support assembly when unfolded lying in a general horizontal plane with said anchor assembly.

9. The canopy as defined in claim 8 wherein said anchor assembly includes extension means for selectively increasing or decreasing the length of said anchor assembly for selectively controlling the distance between said support assembly and a vehicle when a vehicle tire is positioned on said anchoring assembly.

10. The canopy as defined in claim 7 wherein said anchoring means is elongated and has opposite end portions, one said end portion being adapted to have a vehicle tire placed thereon for holding said cover fixedly in place on said poles and another end portion, said another end portion including pivot means for pivotally mounting said support assembly thereto, said anchor assembly further including telescoping extension means for selectively lengthening said anchor assembly for controlling the distance said support assembly is away from a vehicle tire resting on said one end portion.

11. The canopy as defined in claim 10 wherein said telescoping extension means further includes selectively operable positive locking means for securing said anchor assembly into one of a plurality of positions.

12. The canopy as defined in claim 7 wherein said means for movably mounting includes positive locking means for securing said holding member in a plurality of fixed positions.

13. A portable canopy for use with motor vehicles comprising a pair of canopy assemblies, said canopy assemblies including a pair of anchor assemblies adapted to fit under adjacent tires of a vehicle, each said canopy assembly including a support assembly, a pivot means connected between said anchor and support assemblies for folding said support assembly onto said anchor assembly in a stored position and unfolding said support assembly onto a generally flat surface in an operative posi, each said support assembly including an elongate pole holding member having opposite end portions and a lengthwise axis, and a plurality of spaced canopy poles each having an upper end and a lower end, said lower ends being removably mounted to said holding member, and cover means including at least one tarp adaptable to be mounted to said upper ends of said canopy poles, said support assembly further including means for selectively movably mounting said pole holding member about said axis.

14. The canopy as defined in claim 13 wherein each said anchor assembly includes extension means for selectively increasing or decreasing the length of said anchor assembly for selectively controlling the distance between said support assembly and a vehicle when a vehicle tire is positioned on said anchor assembly.

15. The canopy as defined in claim 13 wherein each said anchor assembly is elongated and has opposite end portions, one said end portion being adapted to have a vehicle tire placed thereon for holding said canopy fixedly in place and another end portion, said another end portion including pivot means for pivotally mounting said support assembly thereto, each said anchor assembly further including telescoping extension means for selectively lengthening respective said anchor assembly for controlling the distance respective said support means is away from a vehicle tire resting on said one end portion.

16. The canopy as defined in claim 15 wherein each said telescoping extension means further includes selectively operable positive locking means for securing respective said anchor assembly into one of a plurality of positions.

17. The canopy as defined in claim 13 wherein each said means for selectively mounting includes positive locking means for securing said pole-holding member in a plurality of fixed, spaced, pivoted positions.

18. The canopy as defined in claim 17 wherein said positive locking means includes interlocking parts with one said part being movable away from another said part along said axis and spring means for biasing said one part toward said other part.

19. An anchor assembly for use with a portable cover adapted to fit under a tire on a vehicle comprising a support assembly, a plate member adapted to fit under a tire of a vehicle, means for connecting said support assembly to said plate member, said support assembly including an elongate pole holding member having opposite end portions and a lengthwise axis for supporting a plurality of canopy poles each being removably attachable to said pole holding member, said supporter assembly further including means for movably mounting said holding member for selectively turning said holding member about said axis, said means for connecting including pivot means for folding said support assembly onto said plate member in a stored position and unfolding said support assembly onto a surface for supporting canopy poles.

20. The anchor assembly as defined in claim 19 wherein said plate member is elongated and has opposite end portions, one said end portion being adapted to have a vehicle tire placed thereon for holding said plate member fixedly in place and another end portion, said plate member including telescoping extension means for selectively lengthening said plate member for controlling the distance said support assembly is away from a vehicle tire resting on said one end portion.

21. The anchor assembly as defined in claim 20 wherein said telescoping extension means further includes selectively operable positive locking means for securing said plate member into one of a plurality of positions.

22. The anchor assembly as defined in claim 19 wherein said plate member includes two elongate spaced members to provide for lateral stability of said support assembly when said support assembly is unfolded onto a surface for supporting canopy poles.

23. The anchor assembly as defined in claim 19 wherein said support includes two elongate spaced members to provide for lateral stability of said support assembly when said support assembly is unfolded onto a surface for supporting canopy poles.

24. The anchor assembly as defined in claim 19 wherein said pole holding member includes at least two upstanding sockets for receiving a respective end of two said canopy poles therein, one said socket being substantially for positioning respective said canopy pole substantially perpendicular to said axis, another said socket being at an acute angle to said axis for positioning respective said canopy pole angularly with respect to said axis.

25. The anchor assembly as defined in claim 19 wherein said pole holding member includes at least three upstanding sockets for receiving a respective end of three said canopy poles therein, one said socket being substantially perpendicular to said axis for positioning a canopy pole substantially perpendicular, said other two sockets being spacedly located from said one socket therebetween and being at respective acute angles to said axis for positioning respective said canopy poles angularly in opposite directions with respect to said axis.

* * * * *